US006750610B2

(12) United States Patent
Bechtel et al.

(10) Patent No.: US 6,750,610 B2
(45) Date of Patent: Jun. 15, 2004

(54) PLASMA DISPLAY WITH ENHANCED CONTRAST AND PROTECTIVE LAYER

(75) Inventors: Hans-Helmut Bechtel, Roetgen (DE); Wolfgang Busselt, Roetgen (DE); Joachim Opitz, Aachen (DE); Harald Glaeser, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 13 days.

(21) Appl. No.: 10/111,883

(22) PCT Filed: Aug. 29, 2001

(86) PCT No.: PCT/EP01/10107

§ 371 (c)(1),
(2), (4) Date: Apr. 30, 2002

(87) PCT Pub. No.: WO02/19370

PCT Pub. Date: Mar. 7, 2002

(65) Prior Publication Data

US 2002/0167275 A1 Nov. 14, 2002

(30) Foreign Application Priority Data

Aug. 30, 2000 (DE) ..... 100 42 427

(51) Int. Cl.[7] ..... H01J 17/49

(52) U.S. Cl. ..... 313/587; 313/586; 313/582

(58) Field of Search ..... 313/582–587, 313/495–497

(56) References Cited

U.S. PATENT DOCUMENTS

| | | | | | |
|---|---|---|---|---|---|
| 6,097,149 | A | * | 8/2000 | Miyaji et al. | 313/582 |
| 2001/0017520 | A1 | * | 8/2001 | Masuda et al. | 313/586 |
| 2001/0054871 | A1 | * | 12/2001 | Tadaki et al. | 313/586 |
| 2003/0011307 | A1 | * | 1/2003 | Otani et al. | 313/582 |
| 2003/0062836 | A1 | * | 4/2003 | Ahn et al. | 313/582 |

FOREIGN PATENT DOCUMENTS

JP 10269951 A 10/1998 ..... H01J/11/02

* cited by examiner

*Primary Examiner*—Nimeshkumar D. Patel
*Assistant Examiner*—German Colón

(57) ABSTRACT

A plasma display panel having a structured black matrix (8) which is coated with a reflecting layer (9) on the side turned away from the viewer. Visible light incident from outside is absorbed by the black matrix (8) and light incident from inside is reflected by the reflecting layer (9). This enhances the LCP value of the whole plasma screen. A protective layer (5) such as MgO is deposited on the black matrix and reflecting layer and so formed over the black matrix and said reflecting layer so as to reduce undesired reactions of the black matrix and the reflecting layer with the dielectric layer, such as during high temperature conditions during manufacture.

4 Claims, 1 Drawing Sheet

PLASMA DISPLAY WITH ENHANCED CONTRAST AND PROTECTIVE LAYER

Figure 1:
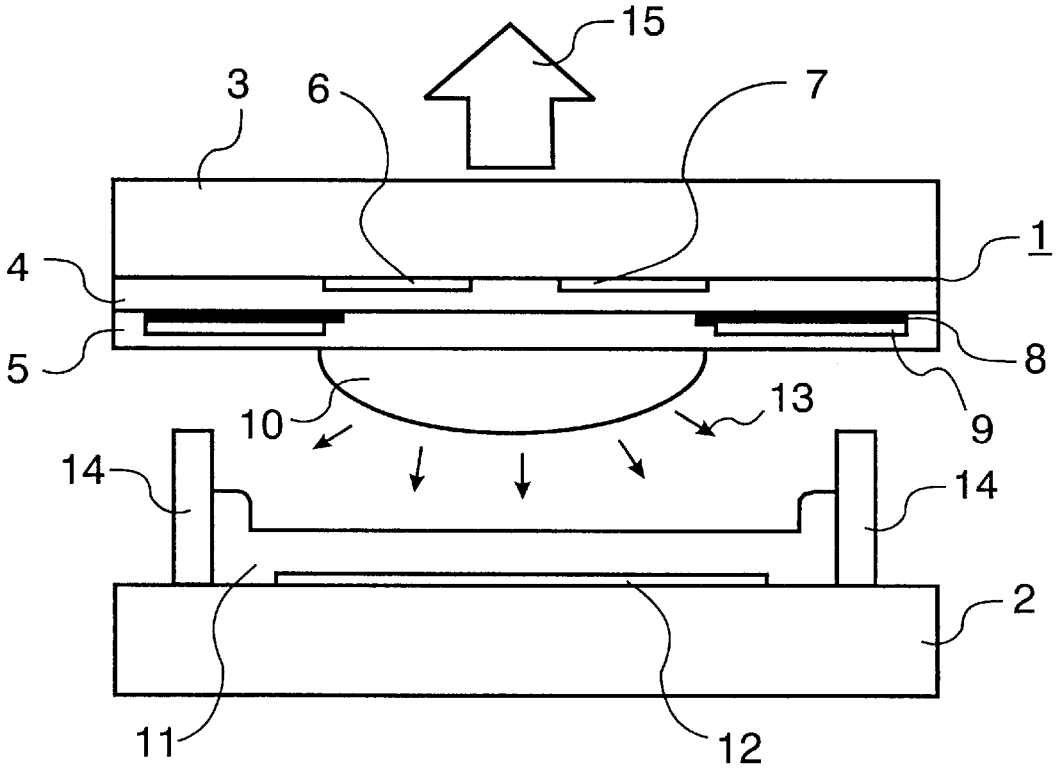

This application is a 371 application of PCT/EP01/10107, filed Aug. 29, 2001.

TECHNICAL FIELD

This invention relates generally to plasma display panels and their construction. Specifically, the invention relates to a plasma screen comprising a front plate which comprises a glass plate on which a dielectric layer and a protective layer are deposited, and comprising a carrier plate coated with a fluorescent layer having a rib structure, which divides the space between front plate and the carrier plate in plasma cells which are filled with a gas, and further comprising one or more electrode arrays on the front plate and the carrier plate for generating silent electrical discharges in the plasma cells.

Plasma screens enable color pictures with high definition, large screen diagonals and have a compact structure. A plasma screen comprises a gas-filled sealed glass cell with grid-like arranged electrodes. By applying an electric voltage, a gas discharge is caused which mainly generates light in the vacuum ultraviolet range. Fluorescence transforms this VUV light into visible light and the front plate of the glass cell emits this visible light to the viewer.

Plasma screens are subdivided into two classes: DC plasma screens and AC plasma screens. With the DC plasma screens the electrodes are in direct contact with the plasma. With AC plasma screens the electrodes are separated from the plasma by a dielectric layer.

In principle, two types of AC plasma screens are distinguished: a matrix arrangement and a co-planar arrangement of the electrode arrays. In the matrix arrangement the gas discharge is ignited and maintained at the point of intersection of two electrodes on the front plate and carrier plate. In the coplanar arrangement the gas discharge between the electrodes on the front plate is maintained and at the point of intersection ignited with an electrode, a so-called address electrode on the carrier plate. The address electrode is located in this case beneath the fluorescent layer. Fluorescent substances which emit different colors are separated by barriers so that only light of the desired color is generated.

For a sufficient picture contrast in daylight it is important for a plasma screen to have a high luminance and the least possible reflection of external light. The parameter of this property is the Luminance Contrast Performance (LCP):

$$LCP = \frac{\text{luminance } (L)}{\sqrt{\text{reflection } (R)}}$$

An enhancement of the contrast and thus an improvement of the LCP value can be achieved, for example, by depositing a so-called black matrix on the barriers or on the areas of the front plate opposite the barriers. Such a black matrix reduces the reflection of ambient light so that the picture contrast is enhanced when the surrounding light is increased.

JP 10-269951 discloses a plasma screen with a black matrix on the front plate which absorbs visible light incident from outside and at the same time reflects light incident from inside. This is achieved in that the side of the black matrix turned away from the viewer is coated with a layer which reflects visible light. This reflecting layer may then be provided directly on the black matrix or parallel therewith with a certain distance.

In either case the black matrix and the reflecting layer are embedded in the dielectric layer, which consists of PbO-containing glass. Under the drastic circumstances during the manufacturing of plasma screens, more particularly high temperatures, this may lead to undesired reactions between the black matrix and/or the reflecting layer with the dielectric layer, which reactions result in discolorations and thus certainly in a reduction of the reflection properties of the reflecting layer.

BACKGROUND AND SUMMARY

Therefore, it is an object of the present invention to provide a plasma display panel or screen which produces a picture with improved contrast.

The object is achieved by a plasma screen comprising a front plate which comprises a glass plate on which a dielectric layer and a protective layer are deposited, comprising a carrier plate coated with a fluorescent layer having a rib structure, which divides the space between front plate and carrier plate in plasma cells which are filled with a gas, and comprising one or more electrode arrays on the front plate and the carrier plate for generating silent electrical discharges in the plasma cells and comprising a structured black matrix which is coated with a reflecting layer between dielectric layer and protective layer on the side turned away from the viewer.

The arrangement of the protective layer and the structured black matrix on which is coated with a reflecting layer is deposited on the side turned away from the viewer, provides that on the dielectric layer and not in the dielectric layer a reaction of the dielectric layer with the reflecting layer is avoided and reactions with the structured black matrix are minimized.

A further advantage of this arrangement is that the reflecting layer on the structured black matrix is closer to the discharge cell. This increases the intensity of the generated light because it is reflected directly and not first passes through the dielectric layer where it may be partially absorbed.

These and other aspects of the invention are apparent from and will be elucidated with reference to the embodiments described hereinafter.

BRIEF DESCRIPTION OF THE DRAWING FIGURES

FIG. 1 shows a generally cross sectional view of a plasma display panel according to the invention, showing structure and function of an individual plasma cell.

DETAILED DESCRIPTION

According to FIG. 1 a plasma cell of an AC plasma screen with a coplanar arrangement of the electrodes is shown and has a front plate 1 and a carrier plate 2. The front plate 1 comprises a glass plate 3 and on the glass plate 3 is deposited a dielectric layer 4, preferably of glass containing PbO. On the glass plate 3 are deposited parallel, strip-like discharge electrodes 6, 7 which are coated with the dielectric layer 4. The discharge electrodes 6, 7 can be made of metal or ITO. On the dielectric layer 4 there is a structured black matrix 8 with a reflecting layer 9 which is embedded in the protective layer 5. The reflecting layer 9 is located on the side of the structured black matrix 8 turned away from the viewer.

The carrier plate 2 is made of glass and parallel, strip-like address electrodes 12 of, for example, Ag, running perpendicularly to the discharge electrodes 6, 7 are deposited on the carrier plate 2. These address electrodes are coated with a fluorescent layer 11 which emits light in one of the basic or desired primary colors e.g., red, green or blue. The individual plasma cells are separated by a rib structure 14 with separating ribs preferably of dielectric material.

Usually, a structured black matrix 8 is deposited on a front plate 1 in strips so that it is always positioned between two pairs of discharge electrodes 6, 7. The strips of the structured black matrix 8 may partially overlap the discharge electrodes 6, 7. The reflecting layer 9 may be as wide as or less wide than the respective strips of the structured black matrix on which it is deposited. The layer thickness of the structured black matrix 8 and of the reflecting layer 9 may be the same or different.

In the plasma cell, that is to say, between the discharge electrodes 6, 7 of which a respective one alternately works as a cathode or anode, there is a gas, preferably a rare gas mixture of, for example, He, Ne or Kr, which contains Xe as an UV light generating component. After the surface discharge has been ignited, so that charges may flow over a discharge path between the discharge electrodes 6, 7 in the plasma area 10, depending on the composition of the gas, a plasma is formed by which radiation 13 is generated in the UV range, more particularly in the VUV range in the plasma area 10. This radiation 13 excites the fluorescent layer 11 which fluorescent layer emits visible light in one of the three basic colors which light emerges through the front plate 1 and thus represents a lighting pixel on the screen. In the fluorescent layer 11 may be used, for example, as blue-emitting fluorescent substance $BaMgAl_{10}O_{17}$:Eu, as a green-emitting fluorescent substance, for example, $Zn_2SiO_4$:Mn and as a red-emitting fluorescent substance, for example (Y,Gd)$BO_3$:Eu.

The structured black matrix 8 absorbs light incident from outside, whereas the reflecting layer 9 reflects visible light 15 incident from the inside.

The dielectric layer 4 over the transparent discharge electrodes 6, 7 is used, for example, in AC plasma screens, for avoiding a direct discharge between the discharge electrodes 6, 7 consisting of conductive material and thus the formation of a light arc when the discharge is ignited.

For manufacturing a front plate 1 having a structured black matrix 8 which is coated with a reflecting layer 9 on the side turned away from the viewer, first the discharge electrodes 6, 7 are deposited by the vapor deposition technique and subsequent structuring on a glass plate 3 whose size corresponds to the desired screen size. Subsequently, the dielectric layer 4 is deposited.

For manufacturing a structured black matrix 8, first a suitable black pigment is dispersed in water with a mixer or mill while dispersing agents are added. As a black pigment may be used, for example, soot, graphite, ferrites such as $MnFe_2O_4$ or spinels such as $Cu(Cr,Mn)_2O_4$, $Cu(Fe,Cr)_2O_4$, $Cu(Fe,Mn)_2O_4$, Ni or $Mn(Mn,Fe,Cr)_2O_4$. To the suspension may be added further additives such as, for example, organic binders, solvents or a defoaming agent. For stabilizing the structured black matrix 8, low-melting glasses or oxides can be added to the suspension.

For manufacturing a reflecting layer 9, first a suitable white pigment which does not absorb in the visible range of the light is dispersed in water with a mixer or mill while dispersing means are added. As a white pigment may be used, for example, $TiO_2$, or $Y_2O_3$. Further additives such as, for example, organic binders, solvents or a defoaming agent may be added to the suspension. For stabilizing the reflecting layer 9, low-melting glasses or oxides may be added to the suspension.

Depositing and structuring the black matrix 8, which is coated with a reflecting layer 9 on the side turned away from the viewer, may be effected with different methods.

One possibility is to replace the obtained suspensions with a photosensitive addition, which may contain, for example, polyvinyl alcohol and sodium dichromate. Subsequently, the suspension with the black pigment is first homogeneously deposited on the dielectric layer 4 by means of spraying, immersing or spin coating. The "wet" film is dried, for example, by heating, infrared radiation or microwave radiation. Subsequently, this step is repeated with the suspension with the white pigment.

The obtained black matrix 8 which is coated with a reflecting layer 9 on the side turned away from the viewer is exposed by a mask and the exposed surfaces are cured. By spraying with water the non-exposed areas are rinsed and removed.

Another possibility is represented by the so-called lift-off method. First a photosensitive polymer layer is then deposited on the dielectric layer 4 and, subsequently, exposed through a mask. The exposed areas are cross-linked and the unexposed areas are deposited by a developing step. The black pigment suspension on the remaining polymer sample is removed by means of spraying, immersing or spin coating and this suspension is then dried. After this, the suspension with the white pigment is similarly deposited on the black matrix and dried. A reactive dissolution caused by, for example, a strong acid, makes the cross-linked polymer soluble. By spraying a developer, the polymer together with parts of the covering black matrix 8 and the parts of the covering reflecting layer 9 is removed, whereas the black matrix 8 direct stuck on the dielectric layer 4 together with its covering reflecting layer 9 is not removed.

A further possibility of manufacturing a structured black matrix 8, which is coated with a reflecting layer 9 on the side turned away from the viewer, is the flexographic printing method. This is a high-pressure method in which only the areas of the dielectric layer 4 to be coated come into contact with the print drum.

Subsequently, a protective layer 5 of MgO is deposited on the reflecting layer 9 and in the spaces between the black matrix/reflecting layer units. The whole front plate 1 is dried, post-processed for two hours at 400° C. and, together with a carrier plate 2 of glass which has a rib structure 14, conducting address electrodes 12 and a fluorescent layer 11, as well as a gas, used for forming an AC plasma screen with improved LCP value.

In the following examples of embodiment of the invention will be explained.

Embodiment 1

For manufacturing a front plate 1 with a structured black matrix 8 and a reflecting layer 9, first 62.5 g of graphite having a mean particle diameter smaller than 1 $\mu$m is mixed in a dispersing means solution of 31.25 g of a pigment-affine dispersing means in 530 g of water by mixing it well. The suspension obtained was mixed with 10 g of a 5% watery solution of a non-ionogenic defoaming agent and ground with glass spheres in a ball mill. In this way a stable, fine-particle suspension was obtained which was filtered by a wire gauze. The suspension was mixed with a 10% polyvinyl alcohol solution and, in addition, sodium dichromate was added to the suspension. (The polyvinyl-alcohol-to-sodium dichromate proportion was 10:1).

Furthermore, an analogous suspension of $TiO_2$ with a mean particle diameter of 300 nm was made which was subsequently mixed with a 10% polyvinyl alcohol solution and with sodium-dichromate (polyvinyl alcohol/sodium dichromate=10:1).

The suspension of the black pigment was deposited on the dielectric layer 4 of a front plate 1 by means of spin coating, which front plate 1 comprised a glass plate 3, a dielectric layer 4 and discharge electrodes 6, 7. The dielectric layer 4 comprised PbO-containing glass and the two discharge electrodes 6, 7 were made of ITO. The distance between the two discharge electrodes was 60 $\mu$m in a screen line, the distance between two screen lines was 500 $\mu$m. After drying the obtained black matrix which is to be covered with a reflecting layer on the side turned away from the viewer, the suspension of the white pigment was deposited on the black matrix 8 by means of spin coating.

The black matrix 8 with a reflecting layer 9 was radiated with UV light through a mask and thus the polymer on the radiated positions was cross-linked. Subsequently, by spraying with warm water the non-cross-linked areas of the black matrix 8 and of the reflecting layer 9 were rinsed. The width of a row of the structured black matrix 8 was 400 $\mu$m.

The whole front plate 1 was dried and post-processed at 450° C. for two hours. Subsequently, the protective layer 5 of MgO was deposited.

The layer thickness of the dielectric layer 4 was 30 $\mu$m, the layer thickness of the black matrix 8 was 3 $\mu$m and the layer thickness of the reflecting layer 9 was 10 $\mu$m.

The obtained front plate 1 together with a carrier plate 2 of glass, which has a rib structure 14, address electrodes 12 of Ag and a fluorescent layer 11 and also with a xenon-containing gas mixture was used for manufacturing a plasma screen whose LCP value was increased by 15%.

Embodiment 2

For manufacturing a front plate 1 with a structured black matrix 8 which is coated with a reflecting layer 9 on the side turned away from the viewer, first 62.5 g $Cu(Cr,Mn)_2O_4$ having a mean particle diameter smaller than 1 $\mu$m, is mixed with the five-fold mixture of low-temperature melting glass. After water and an anorganic binding agent were added, the black matrix 8 was printed on the dielectric layer 4 of a front plate 1 by means of flexoprinting, which front plate 1 comprised a glass plate 3, a dielectric layer 4 and discharge electrodes 6, 7. The structured black matrix 8 was dried at 150° C. Subsequently, the reflecting layer 9 was similarly printed by means of flexoprinting on the structured black matrix 8. For this purpose, 62.5 g of $Y_2O_3$ having a mean particle diameter of 500 nm was mixed with the five-fold mixture of low-temperature melting glass and then water and a binding agent were added to this mixture.

The distance between the two discharge electrodes 6 and 7 in a screen line was 60 $\mu$m, the distance between two screen lines was 500 $\mu$m and the width of one row of the structured black matrix 8 which is coated with a reflecting layer 9 was 600 $\mu$m.

The whole front plate 1 was dried and post-processed at 450° C. for two hours. Subsequently, the protective layer 5 of MgO was deposited.

The layer thickness of the dielectric layer 4 was 30 $\mu$m, the layer thickness of the structured black matrix 8 was 5 $\mu$m and the layer thickness of the reflecting layer 9 was 20 $\mu$m.

The obtained front plate 1, together with a carrier plate 2 of glass, which has a rib structure 14, address electrodes 12 of Ag and a fluorescent layer 11 and also with a xenon-containing gas mixture was used for manufacturing a plasma screen.

What is claimed is:

1. A plasma screen comprising a front plate (1) which comprises a glass plate (3) on which a dielectric layer (4) and a protective layer (5) are deposited, comprising a carrier plate (2) coated with a fluorescent layer (11) having a rib structure (14), which divides the space between front plate (1) and carrier plate (2) in plasma cells which are filled with a gas, and comprising one or more electrode arrays (6, 7, 12) on the front plate (1) and the carrier plate (2) for generating silent electrical discharges in the plasma cells and comprising a structured black matrix (8) which is coated with a reflecting layer (9) between dielectric layer (4) and protective layer (5) on the side turned away from the viewer, said protective layer so formed and deposited over said black matrix and said reflecting layer so as to reduce undesired reactions of said black matrix and said reflecting layer with said dielectric layer.

2. The plasma screen of claim 1, wherein said protective layer is substantially formed from magnesium oxide (MgO).

3. A method for preventing undesired chemical reactions of black matrix and reflecting layers with dielectric layers on the front plate of high contrast plasma display panels, comprising:

depositing a protective layer over said dielectric layer, said black matrix, and said reflecting layers, said protective layer so formed and deposited over said black matrix and said reflecting layer so as to reduce undesired reactions of said black matrix and said reflecting layer with said dielectric layer.

4. The method of claim 3, wherein said protective layer is substantially formed from magnesium oxide (MgO).

* * * * *